US006230510B1

(12) United States Patent
Price

(10) Patent No.: US 6,230,510 B1
(45) **Date of Patent: *May 15, 2001**

(54) RETROFIT CONSOLE AIR CONDITIONING UNIT

(76) Inventor: Miller Price, 1081 St. Ives, Morristown, TN (US) 37815

( * ) Notice: Subject to any disclaimer, the term of this patent is extended or adjusted under 35 U.S.C. 154(b) by 0 days.

This patent is subject to a terminal disclaimer.

(21) Appl. No.: 09/435,798

(22) Filed: Nov. 8, 1999

Related U.S. Application Data

(63) Continuation of application No. 08/968,611, filed on Nov. 13, 1997, now Pat. No. 5,979,169, which is a continuation-in-part of application No. 08/642,444, filed on May 3, 1996, now Pat. No. 5,687,581.

(51) Int. Cl.[7] ..... F25D 23/12; F25D 17/06; A47B 77/08

(52) U.S. Cl. ..... 62/263; 62/259.1; 312/236

(58) Field of Search ..... 62/263, 259.1, 62/298; 312/236

(56) References Cited

U.S. PATENT DOCUMENTS

| | | | | |
|---|---|---|---|---|
| 3,611,743 | | 10/1971 | Manganaro | 62/262 X |
| 4,100,763 | | 7/1978 | Brody | 62/238.7 |
| 4,480,533 | | 11/1984 | Bolton et al. | 165/24 |
| 4,733,543 | | 3/1988 | Blair | 312/236 |
| 4,854,376 | | 8/1989 | Tunekawa et al. | 165/54 |
| 4,974,915 | | 12/1990 | Bussard | 312/236 |
| 5,293,758 | | 3/1994 | Ames et al. | 312/236 |
| 5,308,156 | | 5/1994 | Gutierrez | 312/236 |
| 5,404,939 | | 4/1995 | Lim et al. . | |
| 5,687,581 | | 11/1997 | Price | 62/263 |
| 5,979,169 | * | 11/1999 | Price | 62/263 |

OTHER PUBLICATIONS

CME Custom Mechanical Equipment(Lennox®Industries Inc.) Pulse Unit Ventilation PUV Classroom Unit brochure (Feb. 1997).

Three photographs of a CME unit believed to have been installed during Aug. of 1995 in a classroom at Central Elementary School, O'Fallon, Illinois.

* cited by examiner

*Primary Examiner*—William Doerrler
(74) *Attorney, Agent, or Firm*—Carter & Schnedler, P.A.

(57) ABSTRACT

Console air conditioning units particularly useful for retrofit conversions, but having advantageous features for new installations as well. For retrofit applications, the console air conditioning units have the same "footprint" as an original package unit, and accordingly can be used to replace a worn-out console package unit without requiring any architectural changes. An indoor cabinet is subdivided at least into a plenum compartment having an air discharge opening and either a machinery compartment or a room air return compartment. The machinery compartment or room air return compartment occupies only a portion of the width of the cabinet, and a utility storage volume occupies an adjacent portion of the width. Preferably the plenum compartment is located in an upper portion of the cabinet above the machinery compartment or room air return compartment, and extends substantially the entire width of the cabinet along a wall. The machinery compartment may contain either a water-source heat pump or a simple fan/coil unit. The fan/coil unit may comprise a blower and a refrigeration system heat exchanger, or a blower and a heat exchanger supplied with chilled or heated fluid such as water. Alternatively an outdoor package unit may be located on the opposite side of the wall of the building and connected so as to draw in room return air via the room air return compartment and to discharge conditioned air via the plenum compartment.

15 Claims, 11 Drawing Sheets

RETROFIT CONSOLE AIR CONDITIONING UNIT

CROSS-REFERENCE TO RELATED APPLICATION

This is a continuation of patent application Ser. No. 08/968,611, filed Nov. 13, 1997, now U.S. Pat. No. 5,979,169, which is in turn a continuation-in-part of patent application Ser. No. 08/642,444, filed May 3, 1996, now U.S. Pat. No. 5,687,581.

BACKGROUND OF THE INVENTION

The present invention relates generally to console air conditioning units and, more particularly, to console air conditioning units that include a plenum and are suitable for both retrofit and new installations.

A typical so-called console package air conditioning unit comprises a single cabinet containing all of the component parts of an air conditioning system needed to heat or cool a specific zone or region within a building, typically a room, such as a school classroom. The console cabinet unit is ordinarily situated next to an outdoor wall of the building, and has an outdoor air access opening through which outdoor air flows in and out via a duct which passes through a corresponding opening in the building wall.

More particularly, within the console package unit are conventional air conditioning components, such as an indoor air heat exchange coil (which functions as an evaporator coil during cooling mode and as a condenser coil during heating mode), as well as an indoor air blower for circulating indoor air over the indoor air heat exchange coil. Additionally, there are an outdoor air heat exchange coil (which functions as a condenser coil during cooling mode and as an evaporator coil during heating mode), and an outdoor air blower for circulating outdoor air over the outdoor air heat exchange coil via the outdoor access opening. The outdoor air blower draws outdoor air in through the outdoor air access opening, passes this air over surfaces of the outdoor air heat exchange coil, and discharges this air out through the outdoor air access opening. Thus, the "outdoor air heat exchange coil" is physically located within the console cabinet and within the building, but functionally is exposed to outdoor air. Correspondingly, the self-contained console package unit is physically inside the building, but functionally is divided into "outdoor" and "indoor" sections.

As the final major component, a refrigerant compressor is connected in a closed refrigerant circuit with the indoor air heat exchange coil and the outdoor air heat exchange coil, as is well known.

In addition to outdoor air drawn in through the outdoor air access opening for circulating over the outdoor air heat exchange coil, in typical installations a certain amount of outdoor air is drawn in for ventilation purposes, and mixed with indoor air circulating over the indoor air heat exchange coil. Thus, the opening in the wall of the building is sized to provide sufficient air for circulation over the outdoor air heat exchange coil, as well as for ventilation purposes.

Console package air conditioning units, like most mechanical devices, require periodic maintenance. Eventually, the components become worn-out, and the entire console package unit is replaced with an identical one. Such replacement is relatively expensive; a replacement unit typically costs $8,000.00. Moreover, replacement console package units usually are nearly identical to the unit being replaced, which may be thirty years old. The replacement units in general have not been re-designed with modern, more efficient refrigeration components.

A significant consideration in replacement applications is that the console package unit is architecturally part of the building or room within which it is installed. Thus, the unit occupies a particular floor area within the building, termed its "footprint", and the opening in the building wall for outdoor air access is sized to accommodate the outdoor air access opening of the console package air conditioning unit. Thus, in situations where a console package air conditioning unit is replaced in its entirety, it is desirable for the replacement unit to be physically of the same size, that is, with the same "footprint" and fitting the same size wall opening, minimizing or eliminating the need for architectural changes in the room.

Also relevant in the context of the invention are prior art outdoor package air conditioning units. An outdoor package air conditioning unit is a self-contained unit, typically including a heat pump system, containing all of the component parts required for heating or cooling air. The outdoor package unit is ordinarily situated outside a building, near a building exterior wall, and connected via duct work, often extending along the exterior wall of the building, in air communication with additional duct work running inside the building and distributing heated or cooled air flow in a conventional manner.

Additional prior art relevant in the context of the subject invention known as a water source heat pump, which is similar to a console package air conditioning unit comprising a single cabinet and containing all of the component parts of an air conditioning system needed to heat or cool a specific zone or region within a building. A water source heat pump differs however in that, rather than an outdoor air heat exchanger, there is an external fluid heat exchanger which provides heat exchange between the refrigeration system of the water source heat pump and an external water loop. The external water loop includes a pump for water circulation, and is connected to a heat sink, such for example an outdoor cooling tower, a buried serpentine pipe ground heat exchanger or a hot water preheater within the building.

Also relevant in the context of the invention are prior art fan/coil units which are rather simple devices comprising basically a blower which passes room air over an indoor heat exchanger, which is supplied with heated or chilled fluid, such as water, from an external chiller and/or heater, which may comprise a large, central air conditioning unit.

SUMMARY OF THE INVENTION

Accordingly, it is an object of the invention to facilitate the replacement of console package air conditioning units of the type summarized above.

It is another object of the invention to provide relatively-low cost systems for replacing console package air conditioning units.

It is yet another object of the invention to provide systems for replacing a console package air conditioning unit with a more efficient unit.

It is another object of the invention to provide a console package air conditioning units with additional features.

Very briefly, and in overview, the invention provides various embodiments of console air conditioning units which are particularly useful for retrofit conversion, but which have advantageous features for new installation as well. A characteristic common to each of the embodiments is that an indoor cabinet is subdivided at least into a plenum compartment having an air discharge opening and either a machinery compartment or a room air return compartment.

In some embodiments, the machinery compartment or room air return compartment occupies only a portion of the width of the indoor cabinet, and a utility storage volume occupies another portion of the width of the cabinet, adjacent the machinery compartment or room air return compartment. Preferably but not necessarily, the plenum compartment is located in an upper portion of the indoor cabinet above the machinery compartment or room air return compartment, and extends substantially the entire width the cabinet along the wall.

The machinery compartment may contain, for example, either a water-source heat pump or a simple fan/coil unit. The fan/coil unit may comprise a blower and a refrigeration system heat exchanger, or a blower and a heat exchanger supplied with chilled or heated fluid such as water.

Alternatively an outdoor package unit may be located on the opposite side of the wall of the building and connected so as to draw in room return air via the room air return compartment and to discharge conditioned air via the plenum compartment.

As one significant aspect, the console air conditioning unit of the invention is the same physical size as the original package unit, having the same "footprint", and accordingly can be used to replace a worn-out console package unit without requiring any architectural changes.

As another significant aspect, the otherwise-wasted volume within the console unit (which is relatively large since it is the same size as the unit being replaced) as noted above preferably is configured as a utility storage volume, such as bookshelves. This configuration is especially advantageous in a classroom environment.

One advantage is cost. Thus, as noted above, to replace a console package unit with a unit of the same type costs approximately $8,000. The subject system, which employs stock standard air conditioning or heat pump components can be provided at a cost of approximately $4,000. As another significant advantage, standard air conditioning components currently available have much higher efficiencies compared to the components employed in the older console package units being replaced (and compared to the nearly identical replacement units conventionally employed). The use of such components in the practice of the invention allows an improvement in efficiency of 40% to 45% compared to conventional console package units. Further, the unit is much quieter, particularly in the case of those embodiments in which the refrigerant compressor is physically located outside the building.

Moreover, while it might initially be assumed that an indoor console air conditioning unit should be made as small as possible, in practice air velocity and volume requirements dictate a relatively larger unit with a correspondingly larger opening discharging conditioned air into the room. While a given heating or cooling load may be satisfied with a given air handler capacity (expressed in units of volume per interval of time), if the discharge opening is made too small, total static pressure is excessive and the resultant air velocity is relatively greater, causing excessive noise and loss of efficiency. Accordingly, it is desirable to have a relatively large area air discharge opening which handles a relatively high air flow rate (expressed in units of volume per interval of time), but with an acceptably low total static pressure and an acceptably low air flow velocity.

The invention accordingly allows a properly-sized air discharge opening to be provided in accordance with conventional design standards, desirable even in new installations where duplicating the "footprint" of a worn-out unit is not a factor, and yet provides efficient use of space through the provision of a utility storage volume.

In accordance with a more particular aspect of the invention, a retrofit conversion apparatus has an indoor unit including an indoor cabinet sized so as to occupy the same floor area as the single cabinet of a worn-out self-contained package air conditioning unit and so as to cover at least the opening in the wall of the building which allows outdoor air access. The indoor cabinet typically includes a room air return opening communicating with indoor room air for recirculating room air, and a ventilation opening corresponding with the opening in the wall of the building for bringing in outside ventilation air. A damper system is provided for selectively controlling the amount of air drawn in through the ventilation opening to suit different seasonal operating conditions.

The interior of the indoor cabinet is subdivided into at least a plenum compartment, which in some but not all embodiments extends substantially the entire width of the cabinet along the wall, and either a machinery compartment or a room air return compartment. Thus, the plenum compartment, depending upon the particular embodiment, may extend substantially the entire width of the cabinet along the wall, or be only a partial-width plenum. An air discharge opening is formed in a wall of the plenum compartment.

The machinery compartment or the room air return compartment, depending upon the embodiment, occupies only a portion of the width of the indoor cabinet, and the indoor cabinet further includes a utility storage volume occupying another portion of the width of the indoor cabinet adjacent the room air return compartment.

In one embodiment, a water source heat pump is included within the machinery compartment. The water source heat pump has an indoor air heat exchanger, an external fluid heat exchanger, a system refrigerant compressor, and an indoor air mover connected to the plenum compartment for drawing air in through at least one of the room air return opening and the ventilation opening, passing air over surfaces of the indoor air heat exchanger, and discharging air via the plenum compartment through the air discharge opening. In addition, there are fluid line connections for connecting the external fluid heat exchanger to a heat source or a heat sink, depending upon whether the application is for heating or cooling. As examples, the heat sink may comprise an outdoor cooling tower, or a hot water preheated.

In another embodiment, a fan/coil unit is included within the machinery compartment. The fan/coil unit includes an indoor air heat exchanger and an indoor air mover connected to the plenum compartment for drawing air in through at least one of the room air return opening and the ventilation opening, passing air over surfaces of the indoor air heat exchanger, and discharging air via the plenum compartment through the air discharge opening. Additionally, there are fluid line connections for connecting the indoor air heat exchanger to an external chiller, an external heater, or both in a selective arrangement. As an example, the external chiller may comprise a mechanical refrigeration system.

In yet another embodiment, in cases where the indoor cabinet includes a room air return compartment, there is an outdoor unit located on the opposite side of the wall of the building and comprising a package air conditioning unit including a conditioned air discharge port and a return air port. A first transition piece extends through the opening in the wall of the building and connects the room air return compartment to the air return port, and a second transition piece extends to the opening in the wall of the building connecting the conditioned air discharge port to the plenum compartment. In this embodiment, the room air return opening of the indoor cabinet allows room air to enter the room air return compartment.

Preferably, the plenum compartment is located in an upper portion of the indoor cabinet above the machinery compartment or the room air return compartment, and above the storage volume.

In addition to retrofit conversion apparatus, the invention provides console package air conditioning units for new installations within a building along an exterior wall of the building, constructed in the same manner, and providing the same advantages, except that the consideration of architecturally matching the size of a worn-out unit being replaced is not relevant.

BRIEF DESCRIPTION OF THE DRAWINGS

While the novel features of the invention are set forth with particularity in the appended claims, the invention, both as to organization and content, will be better understood and appreciated from the following detailed description, taken in conjunction with the accompanying drawings, in which:

DETAILED DESCRIPTION

Figure 1:
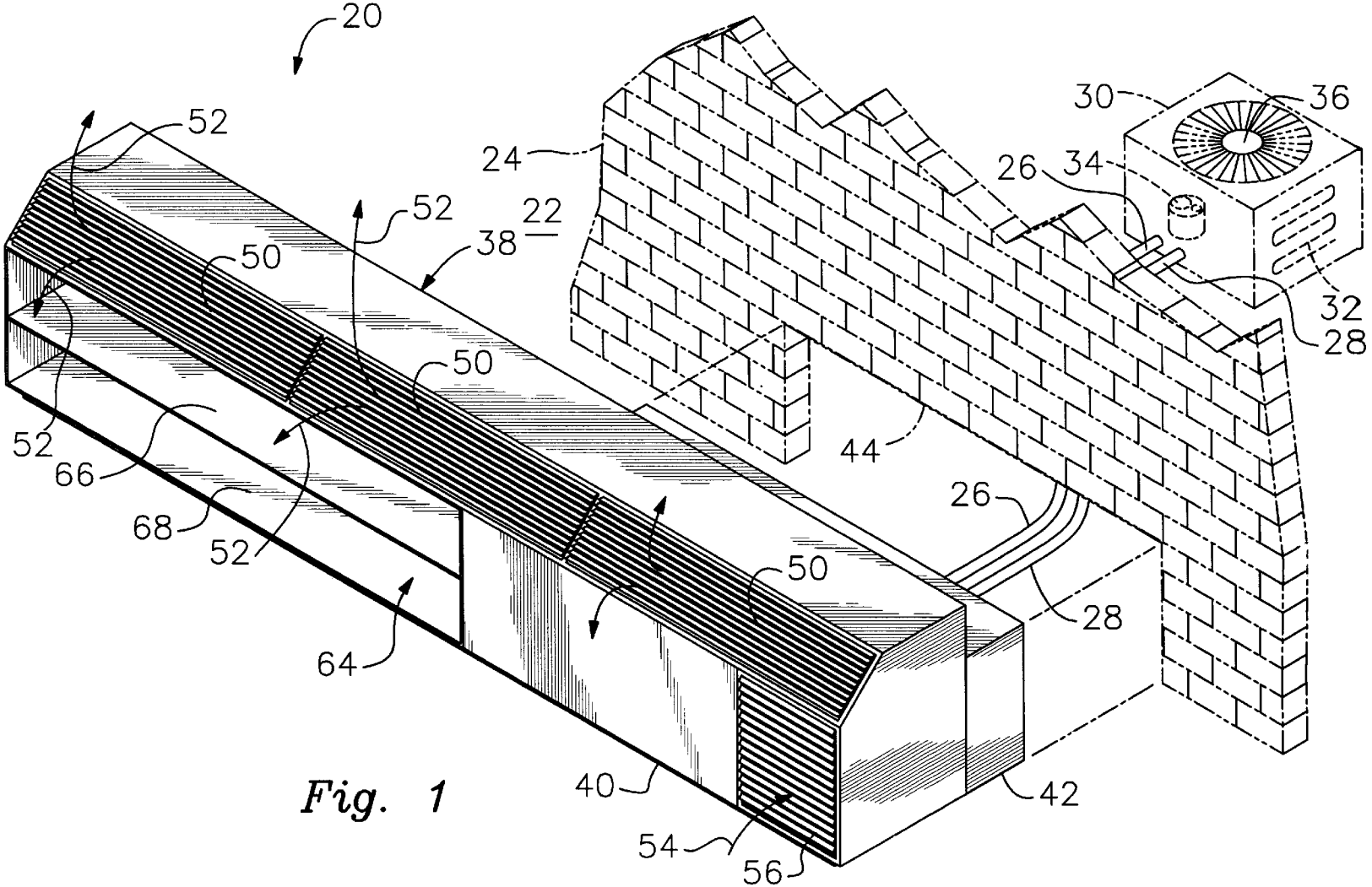
FIG. 1 is an exploded three-dimensional view of a split-system console package air conditioning unit installed within a building along an exterior wall, and connected via refrigerant lines to an outdoor unit.
Figure 2:
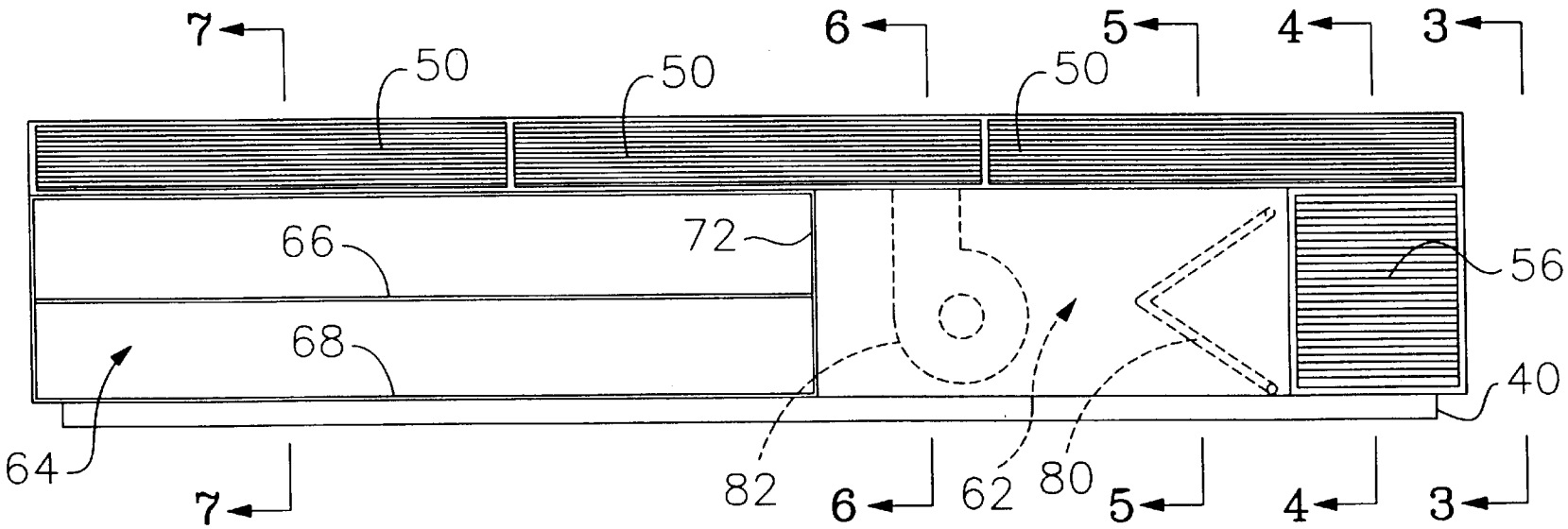
FIG. 2 is a front plan view of the split-system console package air conditioning unit of FIG. 1, showing in dash lines the relative locations of two interior components, an indoor heat exchanger and a blower.
Figure 3:
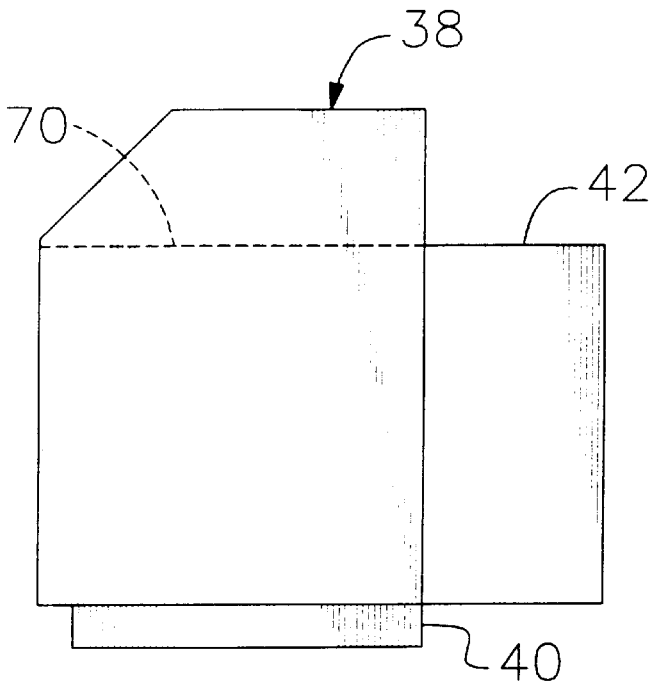
FIG. 3 is a side elevational view of the unit, taken on line 3—3 of FIG. 2.

Referring first to FIG. 1, a split-system console package air conditioning unit generally designated 20 is installed within a building represented by interior space 22 along an exterior wall 24 of the building. The console package unit 20 is connected via refrigerant lines 26 and 28 to an outdoor unit 30 including an outdoor heat exchanger 32, a system refrigerant compressor 34, and a fan 36 for circulating outdoor air over surfaces of the outdoor heat exchanger 32.

The console package air conditioning unit 20 includes an indoor cabinet 38, with a supporting base 40, and a transition duct 42, connected to the rear of the cabinet 38. The duct 42 projects through a corresponding opening 44 in the exterior wall 24 for providing access to outdoor air for ventilation purposes.

In the case of building retrofit installations, the cabinet 38 is sized so as to occupy the same floor area as the single cabinet of a self-contained package air conditioning unit, and so as to cover at least the opening 42 in the building wall 24. Typical dimensions of a retrofit cabinet 38 are 12 ft., 4-½ in. wide; 2 ft., 4-½ in high; and 1 ft., 10 in. depth. Various heating and cooling capacities can be provided.

In the case of a new installation, the cabinet 38 may be of any suitable size, but preferably is of similar dimensions so as to provide adequate area for the discharge of conditioned air into the room, at a suitably low total static pressure.

Thus extending substantially the entire width of the cabinet 38 is a louvered air discharge opening 50, for purposes of example comprising three subdivided sections for mechanical ridgity, and preferably located at an upper portion of the cabinet 38. Discharge air flow out of the opening 50 is represented by arrows 52. Room air, represented by an arrow 54, is drawn in through a louvered room air return opening 56. The air discharge opening 50 has an exemplary area of 12 square feet, while the room air return opening 56 has an exemplary area of three square feet.

With reference now in addition to FIG. 1, to FIGS. 2–9, the interior of the cabinet 38 is subdivided into an upper plenum compartment 60 extending substantially the entire width of the cabinet 38 along the wall 24, and a machinery compartment 62 which occupies only a portion of the width of the indoor cabinet 38. The remainder of the cabinet 38 width advantageously takes the form of a utility storage volume 64, illustrated as open bookshelves 66 and 68, although it will be appreciated that any desired type of storage area may be provided, such as a cabinet with doors.

Subdividing the upper plenum compartment 60 from the machinery compartment 62 and storage volume 64 below is a horizontal panel 70, likewise extending substantially the entire width of the cabinet 38. Subdividing the machinery compartment 62 on the right from the utility storage volume 64 on the left is a vertical panel 72 which extends from near the base of the cabinet 38 to the underside of the horizontal panel 70. In the cross-sectional views of FIGS. 4–7, the left endwall inside the upper plenum chamber 60 is visible, and is designated 74. Likewise, in the cross-sections of FIGS. 4–6, an inside surface within and at the left side of the transition duct 42 is visible, and is designated 76.

Figure 8:
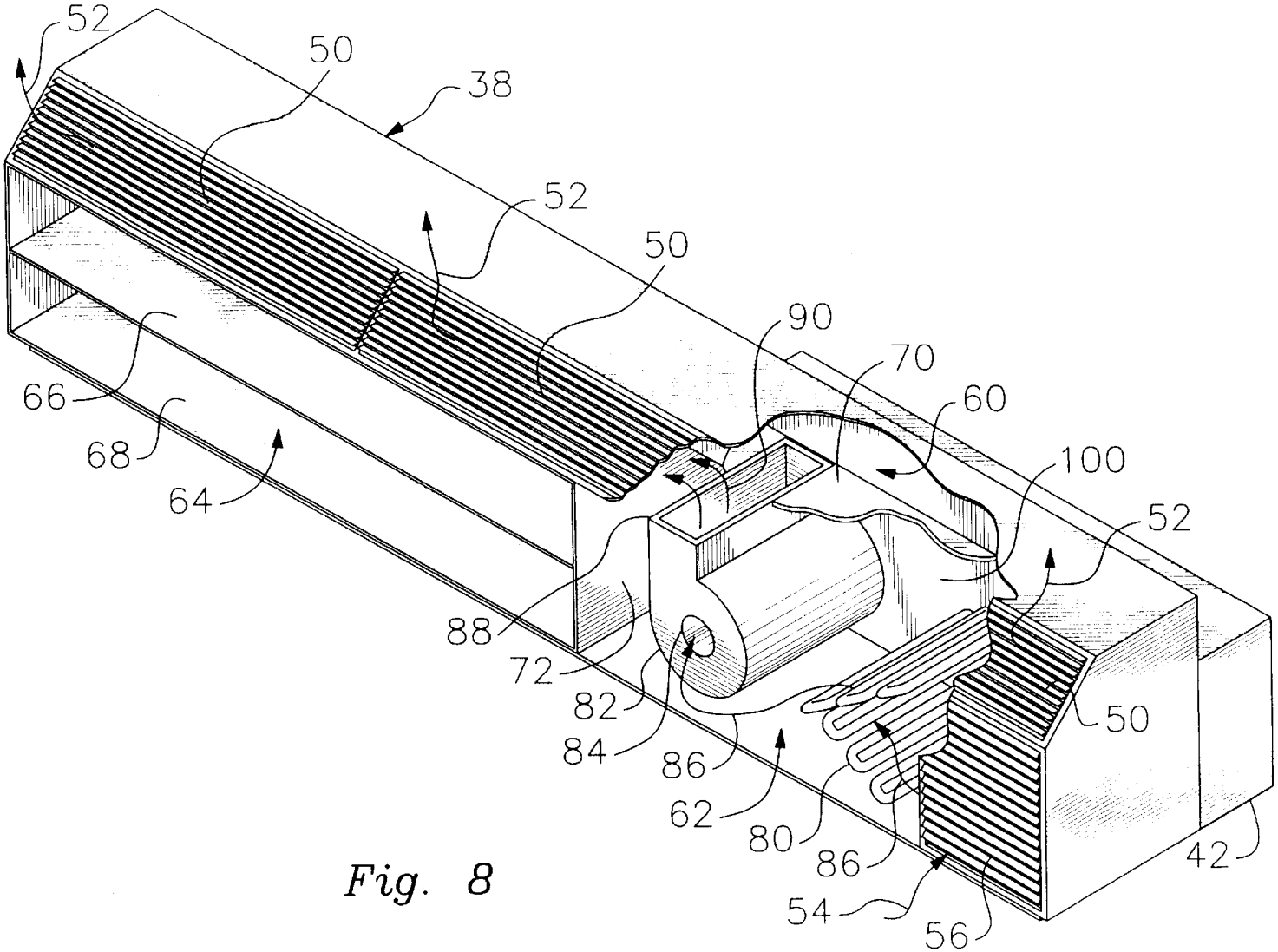
FIG. 8 is a three-dimensional view, partially cut away, showing a portion of the interior of the package air conditioning unit of FIG. 1.

Within the machinery compartment 62 is an indoor heat exchanger 80, and a blower 82 which draws air over the surfaces of the indoor heat exchanger 80 into a blower inlet 84, as represented by arrows 86 (FIG. 8). A blower outlet 88 discharges air, as indicated by arrows 90 into the upper plenum compartment 60, through an aperture 92 (FIG. 6) in the horizontal panel 70. The upper plenum compartment 60 accordingly is pressurized by the blower 82, resulting in air discharge 52 into the room through the louvered openings 50.

Air flow over the indoor heat exchanger 60 is potentially drawn from two sources, the louvered room air return opening 56 drawing in room air 54, and a ventilation opening 96 (FIG. 9) through which outside air is drawn as represented by an arrow 98, via the transition duct 42.

These two air flows 54 and 98 combine, and are drawn by the blower 82 through the indoor heat exchanger, for ultimate discharge into the room 22 through louvered openings 50 as indicated by arrows 52.

Figure 4:
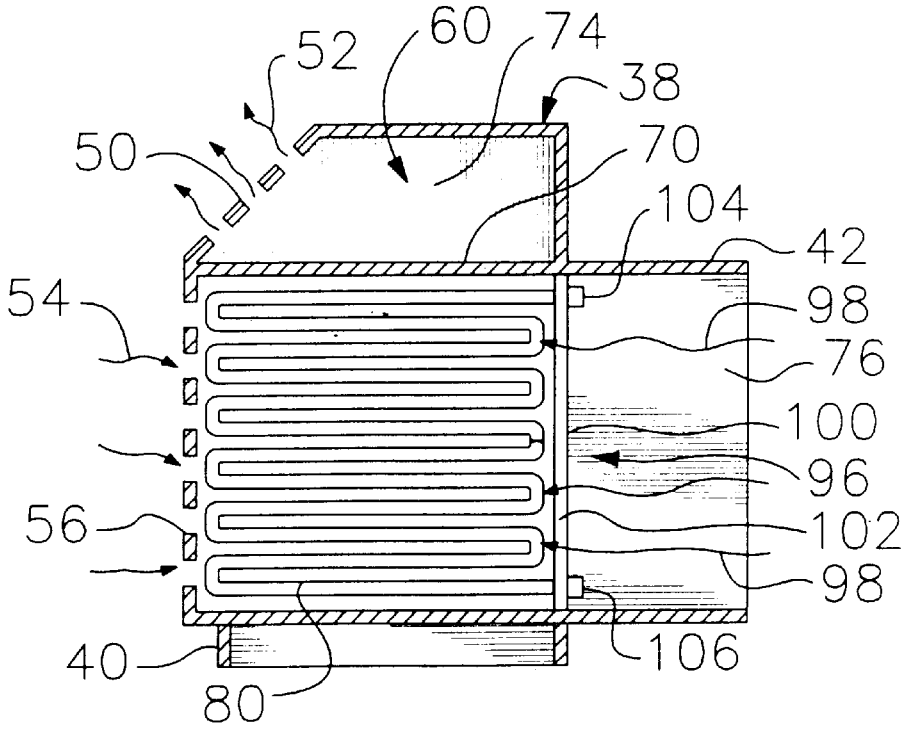
FIG. 4 is a cross-section taken on line 4—4 of FIG. 2.
Figure 5:
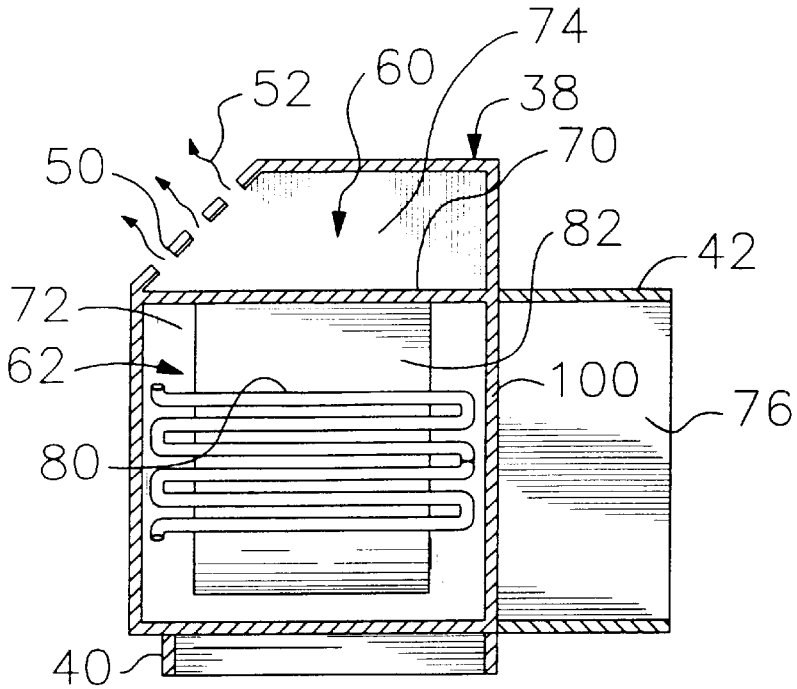
FIG. 5 is a cross-section taken on line 5—5 of FIG. 2 through the indoor heat exchanger.
Figure 6:
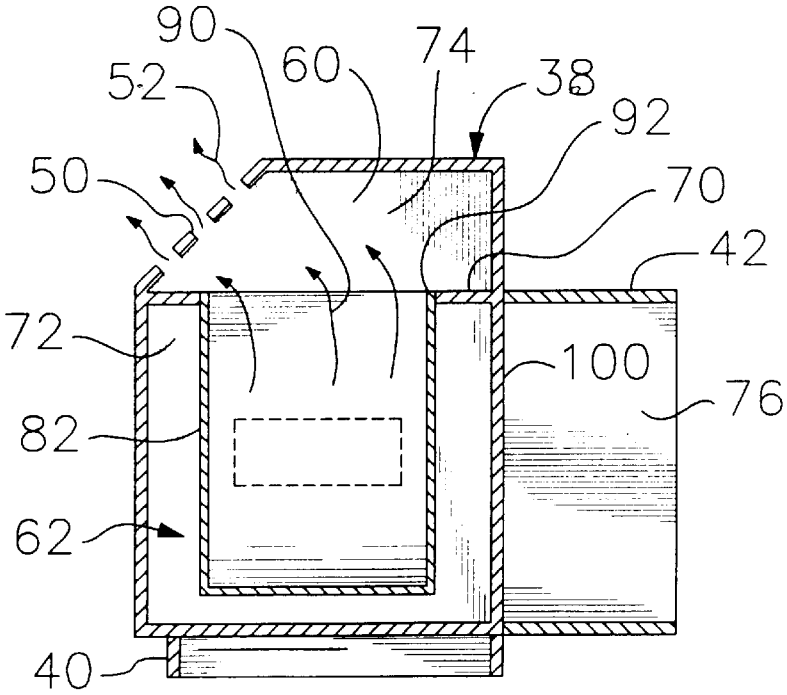
FIG. 6 is a cross-section taken on line 6—6 of FIG. 2 through the blower.
Figure 7:
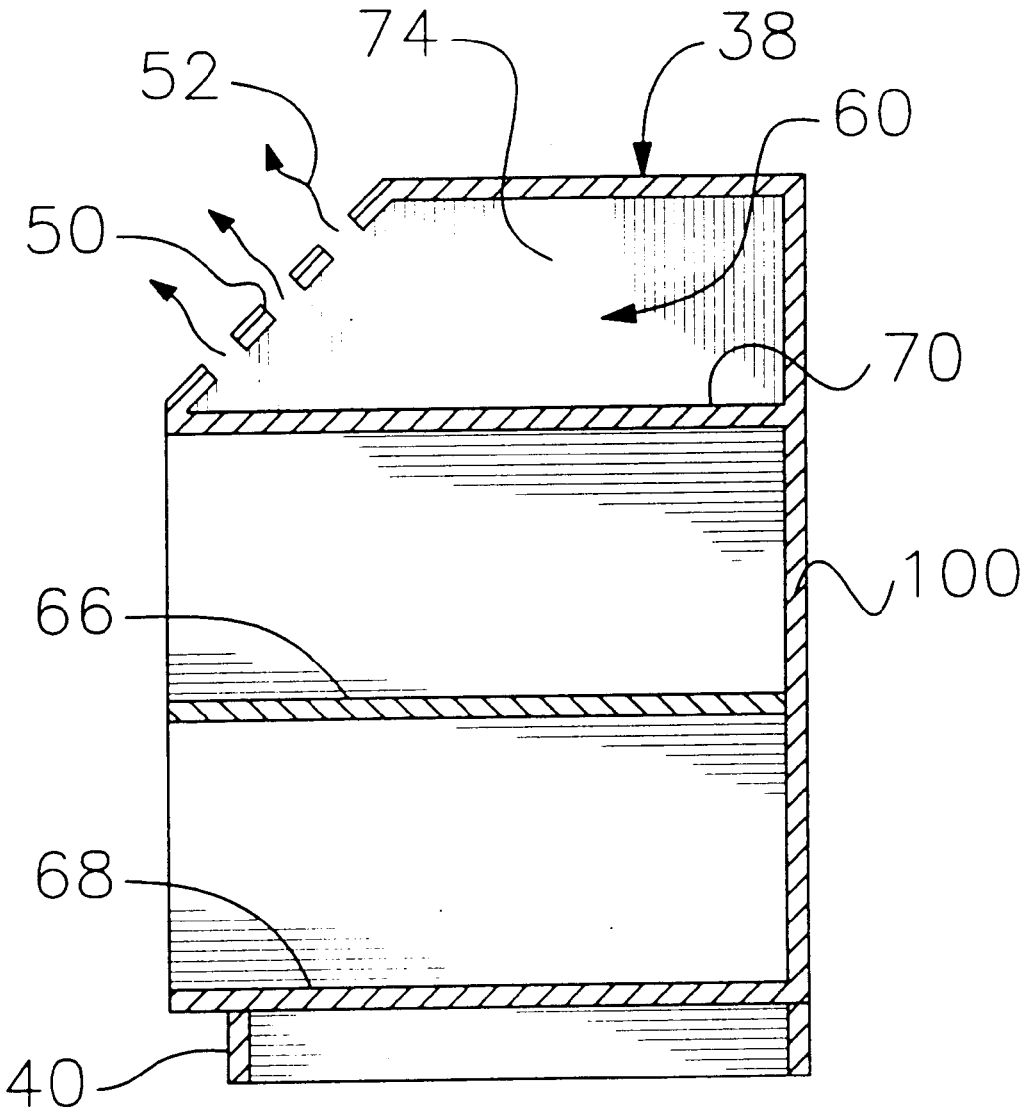
FIG. 7 is a cross-section taken on line 7—7 of FIG. 2 through the bookshelves.
Figure 9:
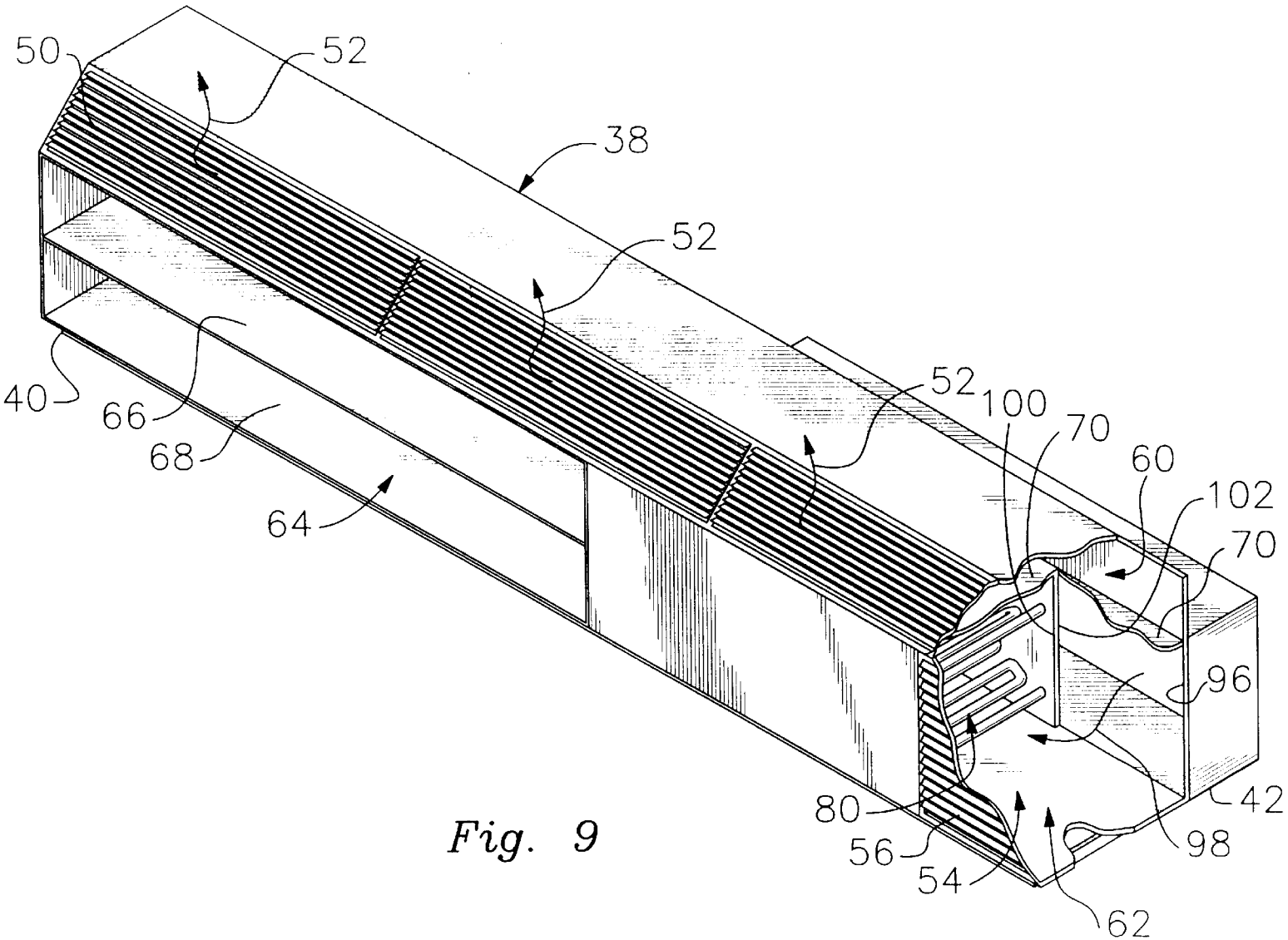
FIG. 9 is a view of the same cabinet with a different portion cut away.

The cabinet 38 has a rear wall 100 which covers nearly all of the back of the cabinet 38, except where the ventilation opening 96 is defined. In FIGS. 4 and 9, a terminating edge 102 of the rear wall 100 is visible, at the opening 96.

The transition duct 42 is sized to accommodate the existing opening 44 in the building wall 24. However, since the indoor unit 20 of the invention does not include the outdoor air heat exchange coil 32, the ventilation opening 96 is significantly smaller than the size of the transition duct 42, and accordingly most of the cross-sectional area of the transition duct 24 is blocked off by the rear wall 100.

By way of example only, apertures are provided in the rear wall 100 through which refrigerant connections 104 and 106 (FIG. 4) project for connecting the indoor heat exchanger 80 to the refrigerant lines 26 and 28, and thus to the outdoor heat exchanger 32 and system refrigerant compressor 34.

It will be appreciated that a complete system also requires a number of conventional control components which are not shown.

In the embodiment as thus far described, room air 54 is drawn in through the room air return opening 56 and outside air flow 98 is drawn in through the ventilation opening 96. It is desirable however that the relative amount of air flow drawn in through the room air return opening 56 and the ventilation opening 96 be selectively controllable. Thus, under some operating conditions, it might be desired to recirculate 100% of the room air 54, and draw no outside air in through the ventilation opening 96. At the opposite extreme, under some conditions, it is desirable to operate the unit 20 as a unit ventilator, wherein all of the air 98 is drawn from the outside through the ventilation opening 96, and no air through the room air return opening 56.

It should be noted that in some applications, such as school classrooms, the ventilation opening 96 must be at least partially open at all times.

Figure 10:
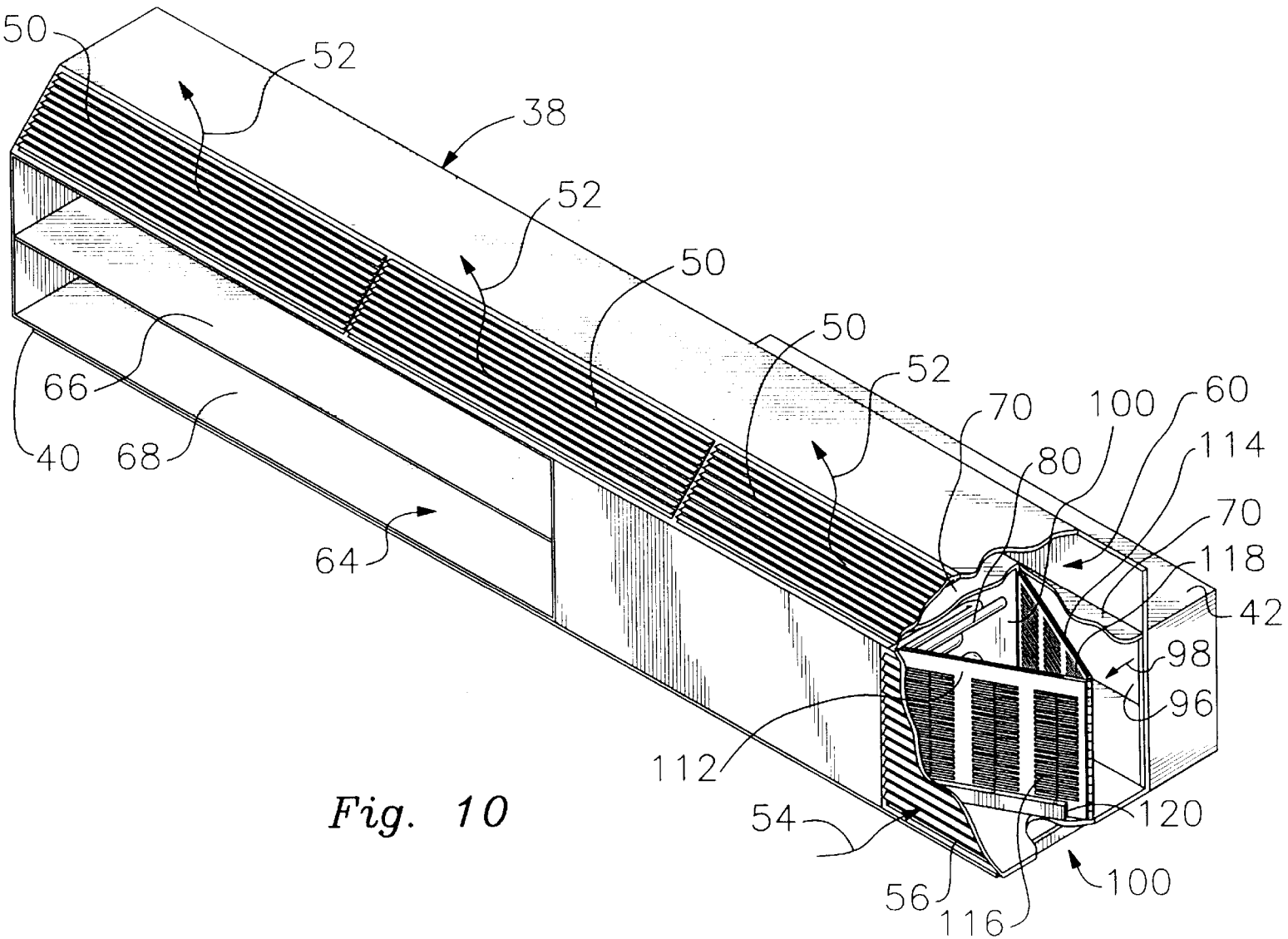
FIG. 10 is a three-dimensional view similar to FIG. 9, showing an optional controlled damper system.

While a variety of arrangements may be employed, FIG. 10 conceptually depicts one arrangement for selectively controlling the relative amount of air drawn in through the room air return opening 56 and the ventilation opening 96. Thus, in FIG. 10, there is a damper system, generally designated 110, including a pair of panels 112 and 114 having respective sets of motorized louvers 116 and 118 for controlling airflow through the respective openings 56 and 96. For purposes of example, an actuator mechanism 120 is shown connected to the motorized louvers 116.

It will be appreciated that the front motorized louvers 116 control the amount of air flow drawn in through the return opening 56, while the rear motorized louvers 118 control the amount of air flow drawn in through the room air ventilation opening 96.

Figure 11:
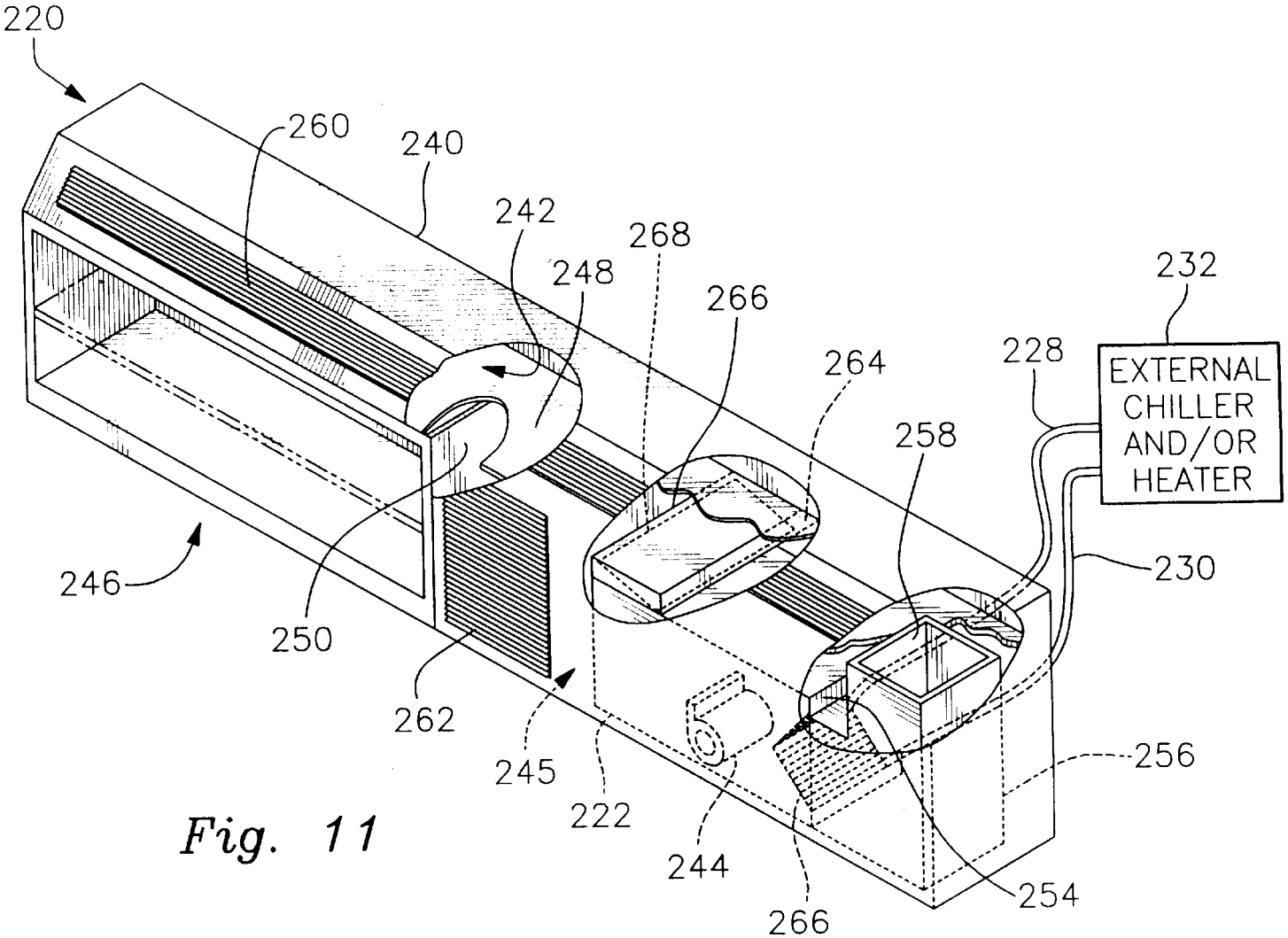
FIG. 11 is a three-dimensional view of another embodiment, in the from of a console air conditioning unit including a fan/coil unit.

Referring next to FIG. 11, depicted is another embodiment of a console air conditioning unit 220 in accordance with the invention, differing from the unit 20 of FIGS. 1–9 in that the unit 220 of FIG. 11 includes a fan/coil unit 222 with an indoor air mover in the form of a blower 224 and an indoor air heat exchanger 226 connected via fluid lines 228 and 230 to an external chiller and/or an external heater 232 including a corresponding heat exchanger (not shown) for transferring heat either to or from fluid, such as water, circulating within the lines 228 and 230. Conceptually, the blower 224 and indoor air heat exchanger 226 of FIG. 11 are no different from the blower 82 and the indoor heat exchanger 80 of the unit 20 of FIGS. 1–9. The FIG. 11 console air conditioning unit 220 differs slightly in its mechanical arrangements compared to the unit 20 of FIGS. 1–9 in various ways that are not relevant to the principles of the invention.

The air conditioning unit 220 of FIG. 11 includes an indoor cabinet 240 which is interiorly subdivided into an upper plenum compartment 242, and a machinery compartment 244. The machinery compartment 244 occupies only a portion of the width of the indoor cabinet, and a utility storage volume in the form a bookshelves 246 is adjacent the machinery compartment 244. In the illustrated embodiment, the plenum compartment 242 in located in an upper portion of the indoor cabinet 240 above the machinery compartment 244 and extends substantially the entire width of the cabinet 240 along the wall (not shown). However, in other embodiments (not illustrated), the plenum compartment 242 may be shortened, for example so as not to extend over the bookshelves 246.

Subdividing the upper plenum compartment 242 from the machinery compartment 244 below is a horizontal panel 248 comprising the bottom of the plenum compartment 242. Subdividing the machinery compartment 244 on the right from the utility storage volume 246 on the left is a vertical panel 250.

The fan/coil unit 222 is a self-contained commercial unit available from a variety of manufacturers and in a variety of configurations. The fan/coil unit 222 generally comprises a rectangular enclosure, having an air inlet end 252 and an air discharge end 254. In the embodiment of FIG. 11, air flow through the fan/coil unit 222 is generally from left to right. Depending upon the particular installation, it will be appreciated the fan/coil unit 222 may be turned around such that air flow is from right to left. The blower 224 and indoor air heat exchanger 226 are depicted in highly schematic fashion, with conventional interconnections and ducting omitted for clarity of illustration.

The air discharge end 254 is connected via an elbow-type transition duct 256 to an aperture 258 in the bottom wall 248 of the plenum compartment 242 so as to pressurize the plenum compartment 242 with air flow which has passed over the surfaces of the indoor air heat exchanger 226.

Formed in an upper wall of the plenum compartment 242 is a louvered air discharge opening 260, through which conditioned air is delivered into the room.

The indoor cabinet 240 has a room air return opening 262 which communicates with room air, and allows room air to enter the inlet 248 of the fan/coil unit 222.

In addition, there is a ventilation opening 264 communicating with the opening (not shown in FIG. 11) in the exterior wall of the building, and connected through a representative duct 266 and damper system 268 so that outside air can enter the fan/coil unit 222, to be drawn by the blower 224 and passed over the surfaces of the indoor air heat exchanger 226.

For cooling applications, the external unit 232 typically comprises a conventional mechanical refrigeration system, including a refrigerant compressor, a condenser coil and an evaporator heat exchange coil which chills water circulating through the fluid lines 228 and 230.

Alternatively the external unit 232 may comprise a heater, fueled by any suitable means for heating water circulating through the fluid lines 228 and 230.

Figure 12:
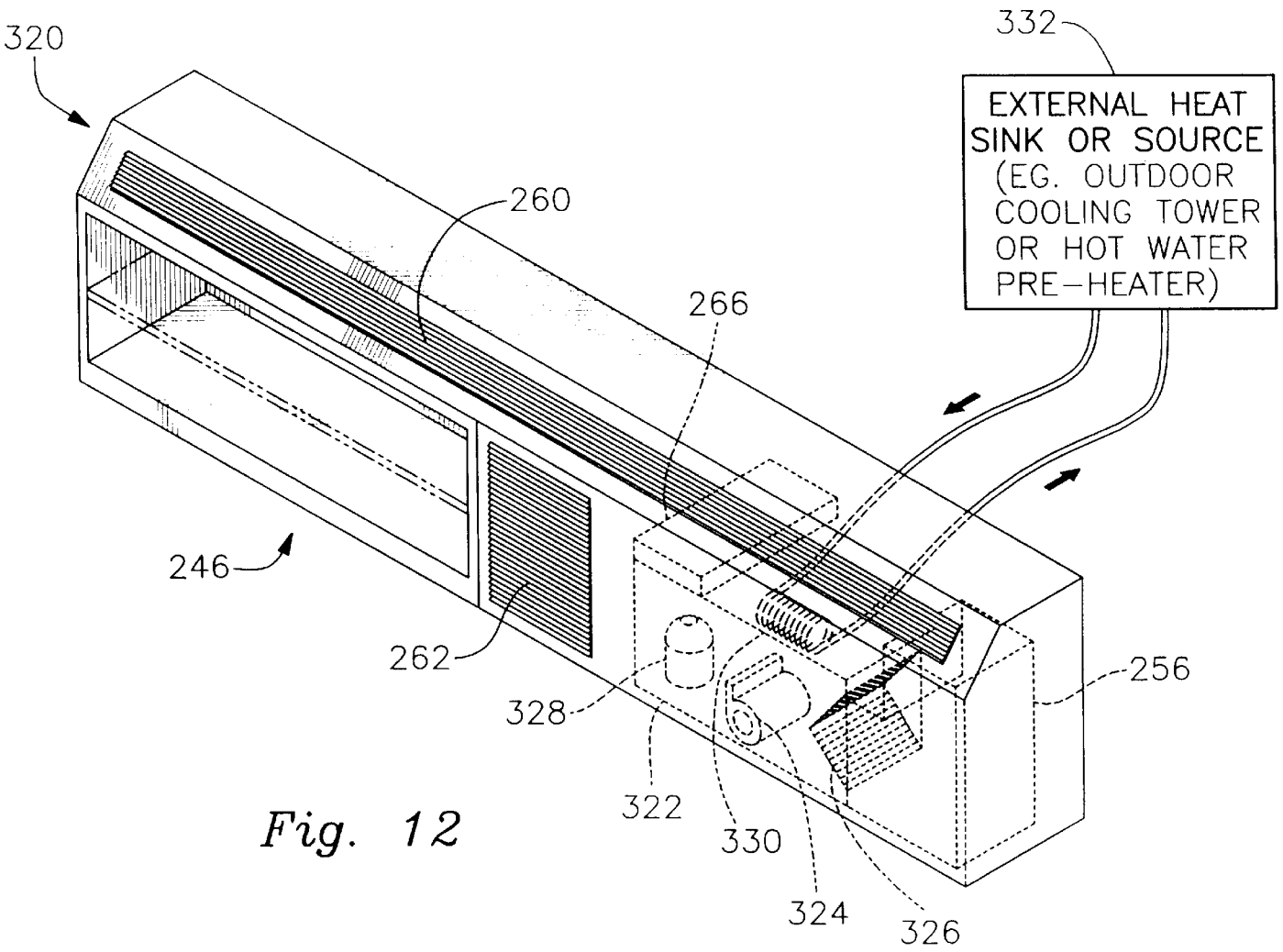
FIG. 12 is a three-dimensional view of yet another embodiment, in the form of a console air conditioning unit including a water source heat pump.

Referring next to FIG. 12, depicted is yet another embodiment of a console air conditioning unit 320, differing from the unit 220 of FIG. 11 in that, instead of the fan/coil unit 222 of FIG. 11, the unit 320 of FIG. 12 includes a water source heat pump unit 322, likewise commercially available in a variety of configurations. The water source heat pump unit 322 includes a blower 324 and an indoor air heat exchanger 326, corresponding in function with the blower 224 and indoor air heat exchanger 226 of FIG. 11.

In addition, the water source heat pump 322 of FIG. 12 includes a refrigerant compressor 328 and an external fluid heat exchanger 330, typically of tube within tube configuration, for heat exchange between the refrigeration system of the water source heat pump 322 and an external heat sink or heat source 332. Thus, during cooling mode operation, the external fluid heat exchanger 320 serves as the condenser of the refrigeration system included within the water source heat pump unit 322, transferring heat to fluid circulating within fluid lines 334 and 336 connecting the external fluid heat exchanger 330 and the external heat sink or heat source 332. The external heat sink 332 may comprise an outdoor cooling tower, a buried serpentine pipe ground heat exchanger, or any other suitable heat sink or heat source, depending upon whether cooling mode or heating mode is involved.

It will be appreciated that the indoor air heat exchanger 326, refrigerant compressor 328, and the external fluid heat exchanger 330 are connected in a conventional closed-loop refrigeration system, including a reversing valve (not shown) where appropriate. The conventional interconnections and exact placements of these elements are not shown for convenience of illustration.

All other details of the unit 320 of FIG. 12 are identical to those of the unit 220 of FIG. 11 having corresponding reference numerals, and are not further described.

Figure 13:
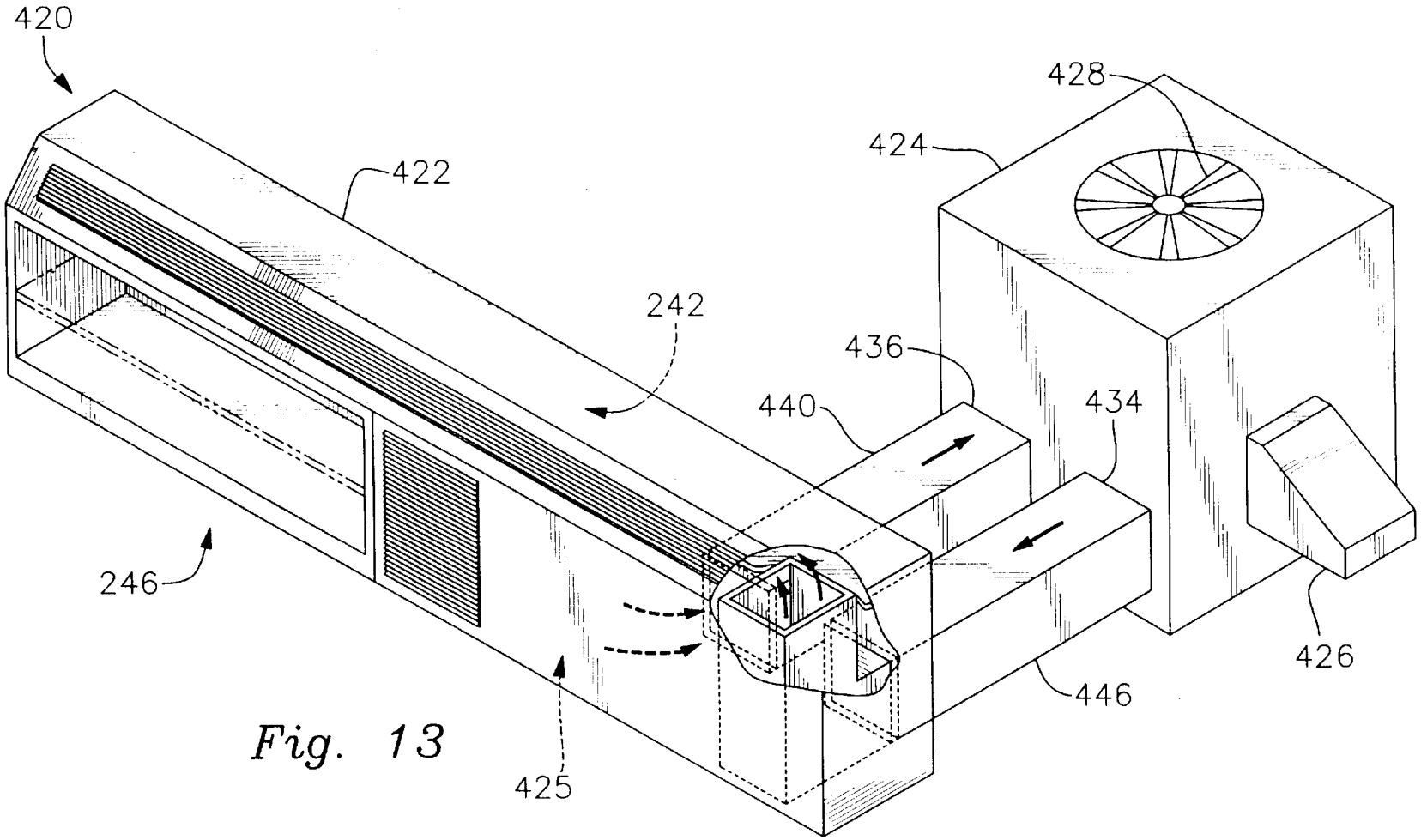
FIG. 13 is a three-dimensional view of still another embodiment, in the form of a console unit connected to an outdoor package air conditioning unit.

Referring finally to FIG. 13, still another embodiment of a console air conditioning unit 420 takes the general form of a console unit cabinet 422 connected to an outdoor package air conditioning unit 424. Although essentially identical in appearance to the previously-described embodiments, the indoor cabinet 422 of the console unit 420 of FIG. 13 does not contain any mechanical components, except perhaps a simple control panel (not shown). Thus, instead of the machinery compartments of the previous embodiments, the unit 420 has a simple room air return compartment 425, and a room air opening 426 allows room air to enter the room air return compartment 425.

The unit 420 still retains the upper plenum compartment 242, and the optional bookshelves 246.

The outdoor package unit 424 is located on the opposite side of the wall of the building, and includes an external air inlet 426 for fresh air ventilation purposes. As one option, the outdoor package unit 424 may comprise a heat pump, with conventional refrigeration components, including a refrigerant compressor, an evaporator, a condenser, a condenser fan 428, and a blower (not shown) for circulating indoor air. As another option, the outdoor package unit 424 may comprise a gas or electric heating and/or heating unit.

In any event, the outdoor package unit 424 has a conditioned air discharge port 434 and a return air port 436.

A first transition piece 440 extends through the opening in the wall of the building, and connects the room air return compartment 425 to the return air port 436 of the outdoor package unit 424. A second transition piece 446 likewise extends through the opening in the wall of the building, and connects the conditioned air discharge port 434 to the plenum compartment 242.

In view of the foregoing, it will be appreciated that the invention provides a lower-cost way of replacing a worn-out console package air conditioning unit, providing the advantages of a system using modern components, while facilitating the replacement of an older unit without requiring architectural changes in the room. In addition, the invention provides a sufficiently large room air discharge opening for acceptably low total static pressure in accordance with conventional heating and air-conditioning design standards, and utilizes the otherwise-wasted space inherent in a cabinet large enough to support the air discharge opening as a storage volume.

While specific embodiments of the invention have been illustrated and described herein, it is realized that numerous modifications and changes will occur to those skilled in the art. It is therefore to be understood that the appendant claims are intended to cover all such modifications and changes as all within the true spirit and scope of the invention.

What is claimed is:

1. Retrofit conversion apparatus for replacing a self-contained package air conditioning unit of the type including within a single cabinet an indoor air heat exchange coil and an indoor air blower for circulating indoor air over the indoor air heat exchange coil, an outdoor air heat exchange coil and an outdoor air blower for circulating outdoor air over the outdoor air heat exchange coil, and a refrigerant compressor connected in a closed refrigerant circuit with the indoor air heat exchange coil and the outdoor air heat exchange coil, the self-contained package air conditioning unit being located within a building, and the single cabinet having an opening allowing outdoor air access to the outdoor air heat exchange coil through a corresponding opening in a wall of the building, and the single cabinet occupying a floor area within the building, said retrofit conversion apparatus comprising:

an indoor unit including an indoor cabinet sized so as to occupy the same floor area as the single cabinet of the self-contained package air conditioning unit and so as to cover at least the opening in the wall of the building;

said indoor cabinet including at least a machinery compartment;

said indoor cabinet having at least one of a room air return opening communicating with indoor room air and a ventilation opening communicating with the opening in the wall of the building;

said indoor cabinet having an air discharge opening;

a water source heat pump within said machinery compartment, said water source heat pump including an indoor air heat exchanger, an external fluid heat exchanger, a system refrigerant compressor, and an indoor air mover connected for drawing air in through said at least one of a room air return opening and a ventilation opening, passing air over surfaces of said indoor air heat exchanger, and discharging air through said air discharge opening; and fluid line connections for connecting said external fluid heat exchanger to at least one of a heat source and a heat sink.

2. The retrofit conversion apparatus of claim 1, wherein said fluid line connections are for connecting said external fluid heat exchanger to a heat sink comprising an outdoor cooling tower.

3. The retrofit conversion apparatus of claim 1, wherein said fluid line connections are for connecting said external fluid heat exchanger to a heat sink comprising a hot water pre-heater.

4. The retrofit conversion apparatus of claim 1, wherein said machinery compartment occupies only a portion of the width of said indoor cabinet, and which further comprises a utility storage volume occupying another portion of the width of said indoor cabinet adjacent said machinery compartment.

5. The retrofit conversion apparatus of claim 1, wherein said air discharge opening is on a sloping front surface of said indoor cabinet.

6. Retrofit conversion apparatus for replacing a self-contained package air conditioning unit of the type including within a single cabinet an indoor air heat exchange coil and an indoor air blower for circulating indoor air over the indoor air heat exchange coil, an outdoor air heat exchange coil and an outdoor air blower for circulating outdoor air over the outdoor air heat exchange coil, and a refrigerant compressor connected in a closed refrigerant circuit with the indoor air heat exchange coil and the outdoor air heat exchange coil, the self-contained package air conditioning unit being located within a building, and the single cabinet having an opening allowing outdoor air access to the outdoor air heat exchange coil through a corresponding opening in a wall of the building, and the single cabinet occupying a floor area within the building, said retrofit conversion apparatus comprising:

an indoor unit including an indoor cabinet sized so as to occupy the same floor area as the single cabinet of the self-contained package air conditioning unit and so as to cover at least the opening in the wall of the building;

said indoor cabinet including at least a machinery compartment;

said indoor cabinet having at least one of a room air return opening communicating with indoor room air and a ventilation opening communicating with the opening in the wall of the building;

said indoor cabinet having an air discharge opening;

a fan/coil unit within said machinery compartment, said fan/coil unit including an indoor air heat exchanger and an indoor air mover connected for drawing air in through said at least one of a room air return opening and a ventilation opening, passing air over surfaces of said indoor air heat exchanger, and discharging air through said air discharge opening; and fluid line connections for connecting said indoor air heat exchanger to at least one of an external chiller and an external heater.

7. The retrofit conversion apparatus of claim 6, wherein said fluid line connections are for connecting said indoor air heat exchanger to an external chiller comprising a mechanical refrigeration system.

8. The retrofit conversion apparatus of claim 6, wherein said machinery compartment occupies only a portion of the width of said indoor cabinet, and which further comprises a utility storage volume occupying another portion of the width of said indoor cabinet adjacent said machinery compartment.

9. The retrofit conversion apparatus of claim 6, wherein said air discharge opening is on a sloping front surface of said indoor cabinet.

10. Retrofit conversion apparatus for replacing a self-contained package air conditioning unit of the type including within a single cabinet an indoor air heat exchange coil and an indoor air blower for circulating indoor air over the indoor air heat exchange coil, an outdoor air heat exchange coil and an outdoor air blower for circulating outdoor air over the outdoor air heat exchange coil, and a refrigerant compressor connected in a closed refrigerant circuit with the indoor air heat exchange coil and the outdoor air heat exchange coil, the self-contained package air conditioning unit being located within a building, and the single cabinet having an opening allowing outdoor air access to the outdoor air heat exchange coil through a corresponding opening in a wall of the building, and the single cabinet occupying a floor area within the building, said retrofit conversion apparatus comprising:

an indoor unit including an indoor cabinet sized so as to occupy the same floor area as the single cabinet of the self-contained package air conditioning unit and so as to cover at least the opening in the wall of the building;

said indoor cabinet including at least a room air return compartment;

said indoor cabinet having a room air return opening for indoor room air to enter said room air return compartment;

said indoor cabinet having an air discharge opening;

an outdoor unit located on the opposite side of the wall of the building and comprising a package air conditioning unit including a conditioned air discharge port and a return air port;

a first transition piece extending through the opening in the wall of the building and connecting said room air return compartment to said return air port; and a second transition piece extending through the opening in the wall of the building and connecting said conditioned air discharge port for discharging air thorough said air discharge opening.

11. The retrofit conversion apparatus of claim 10, wherein said room air return compartment occupies only a portion of the width of said indoor cabinet, and which further comprises a utility storage volume occupying another portion of the width of said indoor cabinet adjacent said room air return compartment.

12. The retrofit conversion apparatus of claim 10, wherein said air discharge opening is on a sloping front surface of said indoor cabinet.

13. Retrofit conversion apparatus for replacing a self-contained package air conditioning unit of the type including within a single cabinet an indoor air heat exchange coil and an indoor air blower for circulating indoor air over the indoor air heat exchange coil, an outdoor air heat exchange coil and an outdoor air blower for circulating outdoor air over the outdoor air heat exchange coil, and a refrigerant compressor connected in a closed refrigerant circuit with the indoor air heat exchange coil and the outdoor air heat exchange coil, the self-contained package air conditioning unit being located within a building, and the single cabinet having an opening allowing outdoor air access to the outdoor air heat exchange coil through a corresponding opening in a wall of the building, and the single cabinet occupying a floor area within the building, said retrofit conversion apparatus comprising:

an indoor unit including an indoor cabinet sized so as to occupy the same floor area as the single cabinet of the self-contained package air conditioning unit and so as to cover at least the opening in the wall of the building;

said indoor cabinet including at least a machinery compartment;

said indoor cabinet having at least one of a room air return opening communicating with indoor room air and a ventilation opening communicating with the opening in the wall of the building;

said indoor cabinet having an air discharge opening; and at least an indoor air heat exchanger and an indoor air mover within said machinery compartment, said indoor air mover being connected for drawing air in through said at least one of a room air return opening and a ventilation opening, passing air over surfaces of said indoor air heat exchanger, and discharging air through said air discharge opening.

14. The retrofit conversion apparatus of claim 13, wherein said machinery compartment occupies only a portion of the width of said indoor cabinet, and which further comprises a utility storage volume occupying another portion of the width of said indoor cabinet adjacent said machinery compartment.

15. The retrofit conversion apparatus of claim 13, wherein said air discharge opening is on a sloping front surface of said indoor cabinet.

* * * * *